United States Patent [19]

Becker

[11] Patent Number: 4,814,729

[45] Date of Patent: Mar. 21, 1989

[54] PRECISELY TUNABLE IMPATT DIODE MODULE FOR WEATHER RADAR APPARATUS

[75] Inventor: Robert A. Becker, Marion, Iowa

[73] Assignee: Rockwell International Corporation, El Segundo, Calif.

[21] Appl. No.: 130,904

[22] Filed: Dec. 9, 1987

[51] Int. Cl.[4] ..... H01P 5/04

[52] U.S. Cl. ..... 333/24 C; 330/287; 331/107 SL; 333/33; 333/246; 333/247; 361/296

[58] Field of Search ..... 333/24 C, 33, 230, 235, 333/246, 247, 260; 331/107 SL; 330/287; 361/287, 296

[56] References Cited

U.S. PATENT DOCUMENTS

| | | | |
|---|---|---|---|
| 3,117,379 | 1/1964 | Ager | 361/296 X |
| 3,603,896 | 9/1971 | Havens . | |
| 3,651,409 | 3/1972 | George et al. | 333/246 X |
| 3,925,740 | 12/1975 | Steensma . | |
| 4,019,161 | 4/1977 | Kimura et al. . | |
| 4,028,652 | 6/1977 | Wakino et al. . | |
| 4,426,628 | 1/1984 | Malecki et al. . | |
| 4,431,974 | 2/1984 | Landt . | |
| 4,455,537 | 6/1984 | LaPrade et al. | 333/246 X |
| 4,471,329 | 9/1984 | Cavalieri d'Oro . | |
| 4,477,788 | 10/1984 | Collinet et al. . | |
| 4,521,747 | 6/1985 | Tahim et al. . | |
| 4,571,555 | 2/1986 | Sigmon et al. . | |
| 4,573,213 | 2/1986 | Dixon, Jr. et al. . | |
| 4,611,186 | 9/1986 | Ziegner | 333/246 |
| 4,617,531 | 10/1986 | Bowlds et al. . | |
| 4,618,836 | 10/1986 | Gannon et al. . | |
| 4,656,438 | 4/1987 | Levinson . | |

*Primary Examiner*—Paul Gensler

*Attorney, Agent, or Firm*—Gregory G. Williams; M. Lee Murrah; H. Fredrick Hamann

[57] ABSTRACT

A microstrip IMPATT circuit tuning mechanism for use with RF producing IMPATT diode combinations including a microstrip circuit board and a external load line connected by a coupling spring attached to the load line and separated from the microstrip circuit by a dielectric layer, the coupling spring being manipulated by a dielectric screw inserted through the housing containing the microstrip board and further having a metallic frequency controlling screw extending through the housing and terminating before the microstrip board.

3 Claims, 2 Drawing Sheets

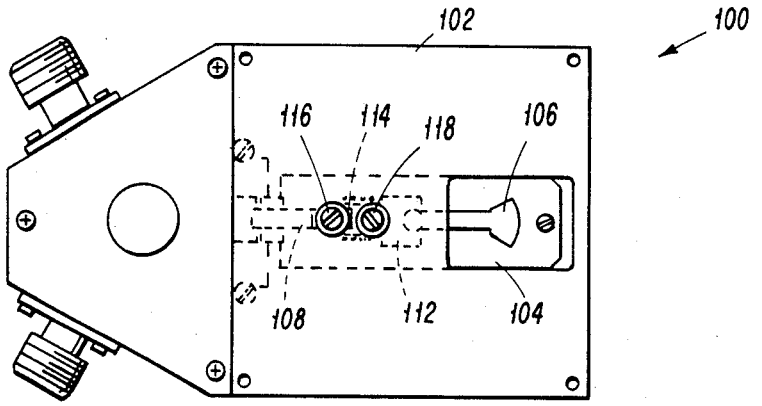
FIG 3
FIG 4
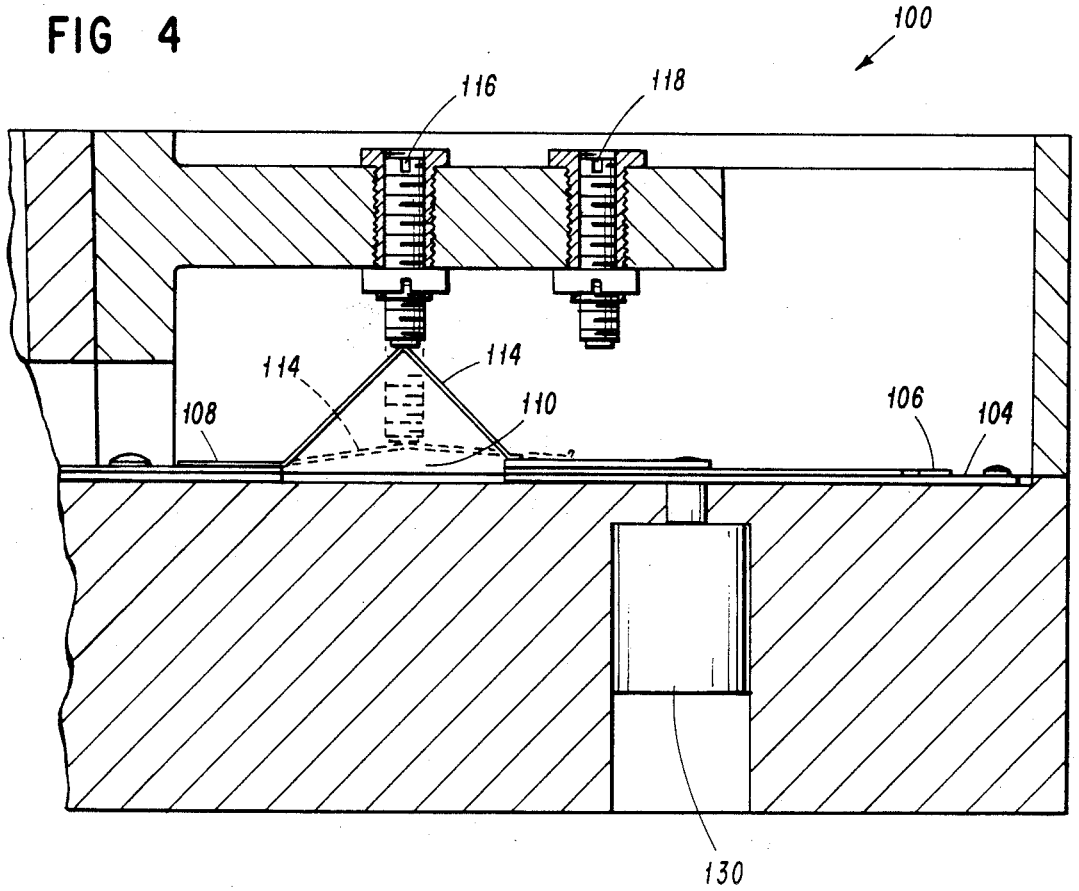

PRECISELY TUNABLE IMPATT DIODE MODULE FOR WEATHER RADAR APPARATUS

BACKGROUND OF THE INVENTION

This invention generally relates to an improved microwave circuit and more particularly relates to an improved structure for providing precisely tunable impedance matching for IMPATT diodes and similar devices.

IMPATT diodes are semi-conductor devices which generate power in the GHz ranges. Their power output and efficiency are dependent on the provision of a proper impedance match when operated as oscillators or amplifiers. Generally, since each diode will have characteristics different from any other diode, it is difficult to provide oscillators of reproducible characteristics or to maximize the operating characteristics of a circuit even when the diodes are produced by the same process. Because of the need for high-power circuits in new technology systems, power coupling from diodes to transmission lines and other systems in oscillator and amplifier circuits has become more critical. As a result, various techniques have been proposed to couple IMPATT diodes and similar devices in circuits designed to improve their efficiency and power output.

In recent systems, it is particularly desirable to combine a number of diodes to produce increased power output. Since no two IMPATT diodes are the same, the circuits necessary to combine the outputs are somewhat inefficient and complex. While there have been attempts to combine only diodes having similar characteristics, matching is difficult and tedious and is often abandoned at the expense of circuit performance. Other attempts have sacrificed the efficiency of diode operation by providing a greater number of diodes in a circuit so that a decrease in performance of a few diode will not effect the overall operation of the circuit.

In other instances, impedance matching devices have been used to match the characteristics of a diode to a specific circuit. Microwave cavity and transmission line circuits have been used to provide a predetermined impedance match to an IMPATT diode. In such cases, however, the impedance cannot be changed and a separate impedance device must be used for each IMPATT diode. In another instance, a combining circuit is constructed with portions for matching impedance depending upon the particular diode attached in the combining circuit. In these instances, the combination can only receive diodes having identical characteristics in order for maximum power and efficiency to be achieved. Accordingly, if one of the diodes becomes inoperable in the combiner circuit, it must be replaced by an identical diode or the efficiency of the circuit will be decreased. The versatility of the coupler is therefore limited since it cannot accommodate diodes of different characteristics.

In addition to the above limitations, prior known devices are generally not acceptable for fighting impedance matching in the miniaturized circuits of current technology. Transmission line and wave guide matching techniques, for example, increase the size and weight requirements of a system where the impedance matching is necessary. In many of the systems, the size and weight become critical and the transmission line and wave guide coupling and impedance matching devices are unsuitable for use. Since present microwave systems employ a wide variety of power combining circuits coupled to utilize the power provided by IMPATT diodes and similar devices, there is a need for additional impedance matching and tuning devices which interface with the miniaturized circuits.

Accordingly, the present invention has been developed to overcome the specific short comings of the above known and similar techniques and to provide a simple and inexpensive microwave coupling circuit for matching and tuning impedance in IMPATT diode oscillator and amplifier circuits.

SUMMARY OF THE INVENTION

It is an object of the present invention to provide an IMPATT module having precisely tunable capacitive coupling for coupling an IMPATT diode with a transmission line.

It is a feature of the present invention to utilize a dielectric screw for adjusting the degree of overlap of a coupling spring with respect to a separate but underlying trace and a separate transmission line.

It is an advantage of the present invention to provide a relatively low cost IMPATT module having a precisely tunable capacitive coupling characteristic.

The present invention provides an IMPATT module having a precisely tunable capacitive coupling characteristic which is designed to fulfill the aforementioned need, satisfy the earlier propounded object, contain the above-described feature, and produce the previously stated advantages. The invention is carried in a "slideless" design, in the sense that the capacitive coupling adjustment is not made by creating an overall translational motion between the circuits to be coupled. Instead, the present invention provides for a precisely tunable capacitive coupling adjustment by allowing for selective adjustment of the bias on a coupling spring which is attached to one transmission line and separated from the other by a thin dielectric.

BRIEF DESCRIPTION OF THE DRAWINGS

The invention may be more fully understood by reading the following description of the preferred embodiments of the invention in conjunction with the appended drawings wherein:

FIG. 3 is an enlarged schematic partial cut-away top view of the IMPATT module of FIG. 1.

FIG. 4 is an enlarged schematic cross-sectional side view of the IMPATT module of FIG. 1.

DETAILED DESCRIPTION

Figure 1:
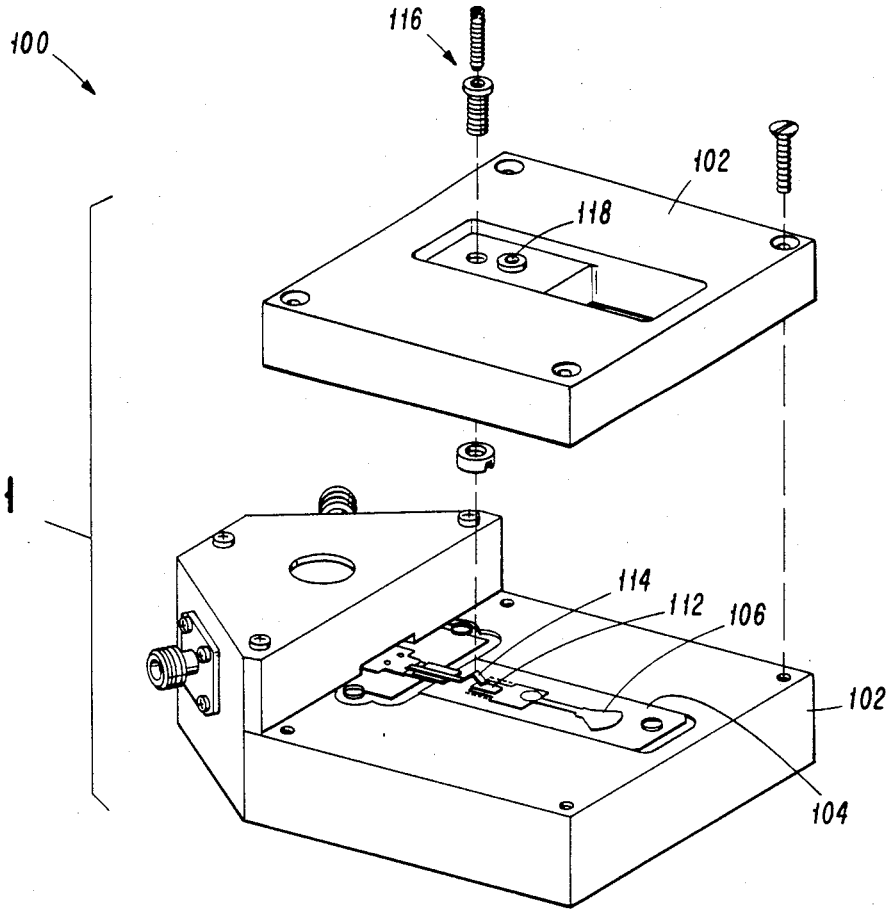
FIG. 1 is an exploded perspective view of the present invention.

Now referring to FIG. 1 there is shown an IMPATT module, generally designated 100, which has a housing 102 with a microstrip circuit 104 disposed therein. Circuit board 104 having a first electronic circuit trace 106 disposed thereon, preferably a resonator circuit, and a second trace 108 disposed thereon, which is preferably a transmission line. Circuit board 104 is shown having a region 110 thereon which is void of any conductive traces thereupon.

Disposed above the first circuit trace 106 is a dielectric plate 112 for electrically separating the first circuit trace 106 from the conductive coupling spring 114 which extends from the second trace 108 towards and above the first trace 106. The dielectric screw 116 is inserted through the housing 102 and is in contact with the coupling pring 114. Also shown is a frequency adjusting screw 118 which accomplishes its adjustment by an introduction of a metallic frequency adjusting screw into the RF field above the resonant circuit 106. This produces a shunt impedance to the resonant circuit which varies with the distance between the metallic adjustment screw and the resonant circuit.

Figure 2:
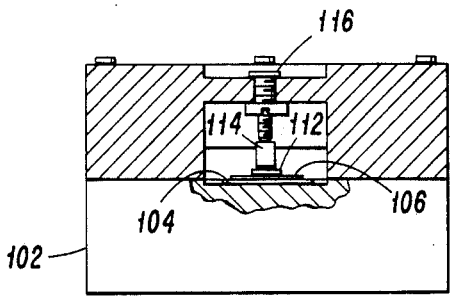
FIG. 2 is an enlarged schematic cross-sectional end view of the IMPATT module of FIG. 1.

Now referring to FIG. 2 there is shown a cross-sectional end view of the IMPATT module of FIG. 1 where the dielectric coupling adjustment screw 116 is shown in engagement with the coupling spring 114 which is separated from the circuit 106 by dielectric 112 all of which are disposed upon circuit board 104 inside of housing 102.

Now referring to FIG. 3 there is shown the IMPATT module of the present invention generally designated 100 having disposed within the housing 102 the resonant circuit trace 106 disposed upon microstrip circuit board 104. Also shown from top view are dielectric coupling adjustment screw 116 and frequency adjusting screw 118. Coupling adjustment screw 116 is disposed directly above coupling spring 114 which is connected with transmission line 108. Coupling spring 114 also is disposed above dielectric layer 112 and portions of a resonant circuit 106.

Now referring to FIG. 4 there is shown an enlarged cross-sectional schematic side-view of the IMPATT module of the present invention, generally designated 100 having a portion of the housing 102 shown with the dielectric coupling adjusting screw 116 and the frequency adjusting screw 118 extending therethrough. Microstrip board 104 is shown having resonant circuit 106 disposed thereon and further having dielectric layer 112 disposed over a portion of resonant circuit 106. Transmission line 108 is shown disposed over a portion of circuit board 104. Coupling spring 114 is attached to transmission line 108 and spans the gap 110 in the traces on circuit board 104 and extends to the dielectric layer 112. IMPATT diode 130 is shown disposed within board 104.

In operation, the coupling from the resonant circuit 106 to the transmission line 108 is selectively adjusted by selectively adjusting the placement of the dielectric coupling adjustment screw 116 through the housing 102. The position of the coupling spring 114 is shown in FIG. 4 by solid lines to be roughly in position for minimum coupling while the dashed lines represent the position of the coupling spring when maximum coupling occurs between the resonant circuit 106 and the transmission line 108. The frequency adjustment is accomplished by the introduction of the metallic frequency adjustment screw 118 into the RF field above the resonant circuit 106. This produces a shunt impedance to the resonant circuit 106 which varies with the distance between the bottom of the frequency adjusting screw 118 and the resonant circuit 106. Maximum frequency is determined by the predetermined characteristics of the IMPATT oscillator circuit with the frequency adjusting screw 118 set at its maximum spacing from the resonant circuit 106. Minimum frequency occurs when the frequency adjusting screw 118 is set as close as is practical to the resonant circuit 106.

It is believed that the IMPATT module of the present invention and many of its intended advantages will be understood by the foregoing description, and it will be apparent that various changes may be made in the form, construction, and arrangements of the parts thereof without departing from the spirit and scope of the invention or sacrificing all of its material advantages, the form hereinbefore described being a merely of exemplary embodiment thereof. It is the intention of the following claims to encompass and include all of such changes.

I claim:

1. An apparatus for coupling an IMPATT diode with a transmission line which has a predetermined impedance characteristic, comprising:

a. an IMPATT diode for generating an RF signal;
b. a trace for carrying an RF signal attached to the IMPATT diode;
c. a transmission line having a predetermined impedance characteristic;
d. a coupling spring attached to the transmission line for coupling with the trace;
e. a dielectric layer disposed above the trace for separating the trace from the spring;
f. a dielectric screw disposed above and engaging the coupling spring for selectively manipulating the bias upon the spring; Whereby, the coupling of the IMPATT diode with the transmission line is accomplished by selectively manipulating the dielectric screw and thereby manipulating the coupling spring into variable position along the dielectric layer and above the trace.

2. An apparatus for providing a DC open circuit and a variable AC circuit at super high frequencies comprising:

a. a circuit board;
b. a first trace having a top-surface for carrying a high frequency signal disposed upon the circuit board;
c. a second trace for carrying a high frequency signal disposed on the circuit board, but separated from the first trace so that, no DC current can pass from the first trace to the second trace;
d. a dielectric layer disposed upon the first trace for prohibiting a direct DC connection at the top surface of the first trace;
e. a coupling spring attached to the second trace and extending toward the top surface of the first trace and separated from the first trace by the dielectric layer;
f. a dielectric screw for selectively manipulating the coupling spring into different positions of overlap with respect to the first trace; Whereby, the first trace and the second trace are maintained as a DC open circuit while the AC signal can be passed from the first trace to the second trace at varying levels depending upon the degree of manipulation of the dielectric screw and the coupling spring.

3. A microstrip IMPATT circuit tuning mechanism comprising:

a. a microstrip circuit board;
b. a housing for containing and supporting the microstrip circuit board;
c. a first trace disposed on the microstrip circuit board for carrying an RF signal;
d. a second trace disposed upon the circuit board and separated from the first trace for carrying a RF signal;
e. a dielectric layer disposed upon the first trace for prohibiting direct electrical DC current flow at the top surface of the first trace;
f. a coupling spring attached to the second trace and extending to the dielectric layer;
g. a dielectric screw extending through the housing and connecting with the coupling spring being capable of manipulation through the housing and thereby manipulating the coupling spring;
h. a frequency adjustment screw extending through the housing and terminating above the dielectric plate.

* * * * *